US008714250B2

(12) United States Patent
Baser et al.

(10) Patent No.: US 8,714,250 B2
(45) Date of Patent: May 6, 2014

(54) MULTILAYERED BALL SEALER AND METHOD OF USE THEREOF

(75) Inventors: Belgin Baser, Houston, TX (US); Curtis L. Boney, Houston, TX (US); Eric Clum, Sugar Land, TX (US); Jorge E. Lopez de Cardenas, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 2 days.

(21) Appl. No.: 12/252,044

(22) Filed: Oct. 15, 2008

(65) Prior Publication Data

US 2009/0101334 A1 Apr. 23, 2009

Related U.S. Application Data

(60) Provisional application No. 60/980,835, filed on Oct. 18, 2007.

(51) Int. Cl.
*E21B 33/13* (2006.01)

(52) U.S. Cl.
USPC ..... 166/284

(58) Field of Classification Search
USPC ..... 166/193, 284
See application file for complete search history.

(56) References Cited

U.S. PATENT DOCUMENTS

| | | | | |
|---|---|---|---|---|
| 2,754,910 | A | 7/1956 | Derrick et al. | |
| 3,376,934 | A * | 4/1968 | William et al. | 166/193 |
| 3,437,147 | A * | 4/1969 | Davies | 166/284 |
| 4,102,401 | A | 7/1978 | Erbstoesser | |
| 4,407,368 | A | 10/1983 | Erbstoesser | |
| 4,410,387 | A * | 10/1983 | Halkerston et al. | 156/245 |
| 4,505,334 | A | 3/1985 | Doner et al. | |
| 4,702,316 | A | 10/1987 | Chung et al. | |
| 4,766,182 | A | 8/1988 | Murdoch et al. | |
| 5,253,709 | A | 10/1993 | Kendrick et al. | |
| 5,485,882 | A | 1/1996 | Bailey et al. | |
| 6,380,138 | B1 | 4/2002 | Ischy et al. | |
| 6,832,651 | B2 * | 12/2004 | Ravi et al. | 166/292 |
| 7,647,964 | B2 * | 1/2010 | Akbar et al. | 166/193 |
| 2006/0175059 | A1 * | 8/2006 | Sinclair et al. | 166/283 |
| 2007/0044958 | A1 * | 3/2007 | Rytlewski et al. | 166/250.01 |
| 2007/0142547 | A1 * | 6/2007 | Vaidya et al. | 524/847 |

FOREIGN PATENT DOCUMENTS

EA 004186 B1 2/2004

OTHER PUBLICATIONS

Bibliographic data with English Abstract of EA004186, 4 pages.

* cited by examiner

*Primary Examiner* — Shane Bomar
*Assistant Examiner* — Kipp Wallace
(74) *Attorney, Agent, or Firm* — Rachel E. Greene; Tim Curington

(57) ABSTRACT

A multilayered ball sealer having a deformable layer. The multilayered ball sealer has an outer or intermediate layer that is deformable under pressure. In the former, the deformable layer may be water-soluble or hydrolysable. In the latter, the outer layer is a sheath that contains the deformable layer and adapts to its shape. A multilayered ball sealer may be used as a diversion agent by being suspended in a fluid injected into a wellbore and applying pressure to deform the shape of the intermediate layer such that the multilayered ball sealer adapts to the shape of a perforation opening on which the multilayered ball sealer has seated.

32 Claims, 11 Drawing Sheets

MULTILAYERED BALL SEALER AND METHOD OF USE THEREOF

CROSS-REFERENCE TO RELATED APPLICATIONS

This application claims the benefit of priority from U.S. Provisional Application No. 60/980,835, filed on Oct. 18, 2007, the entire contents of which are hereby specifically incorporated by reference.

BACKGROUND OF THE INVENTION

1. Technical Field

The present invention relates generally to sealing perforations in a wellbore. More specifically, the disclosure relates to multi-layer ball sealers having a deformable layer to allow the ball sealers to better adapt to different perforation shapes thereby providing better sealing.

2. Background of the Invention

The statements in this section merely provide background information related to the present disclosure and may not constitute prior art.

It is a common practice in the petroleum industry to complete wells that have been drilled into the subsurface of the earth by placing into the well a cylindrical casing and cementing the casing into the well. The casing, and surrounding cement, provides fluid isolation between the well and the formation surrounding the well. To introduce fluid flow between the interior of the casing and the surrounding formation at desired locations in the well, the casing is perforated.

It may become desirable or necessary during the productive life of a reservoir to improve the fluid flow from the reservoir into the well through techniques collectively known as reservoir stimulation. Two commonly used techniques are hydraulic fracturing and chemical stimulation.

Hydraulic fracturing is a process whereby a subterranean hydrocarbon reservoir is stimulated to induce a highly conductive path to a formation, increasing the flow of hydrocarbons from the reservoir. A fracturing fluid is pumped at high pressure to crack the formation, creating larger passageways for hydrocarbon flow. The fracturing fluid may include a proppant, such as sand or other solids that fill the cracks in the formation, so that the fracture remains open when the fracturing treatment has been completed and the high pressure is released.

Chemical stimulation is a process wherein flow through passageways in the formation is improved by dissolving materials in the formation, for example, by pumping acid through perforations in the casing into the formation.

In a trivial case, such as in a well in which only one zone has been perforated or in which treatment can be applied through all perforations, no zonal isolation is necessary. However, in wells with many perforations or multiple pay zones, it is often crucial to a successful reservoir stimulation operation to accurately and effectively isolate one zone for which treatment is to be applied from other zones where treatment is not to be applied. One reason for the need of effective zonal isolation is that treatment fluids, if applied equally to all perforations, are more likely to flow into zones with high permeability rather than into zones with poor permeability, i.e., the zones where permeability-improvement is desired. Therefore, it is desirable in such circumstances to divert the treatment away from the high-permeability zones, so the treatment, whether hydraulic fluid or chemical, does not flow to these zones instead of to the zones for which the treatment is desired.

Zonal isolation is achieved by employing a diversion technique. One approach involves the use of perforation ball sealers. Ball sealers are, as the name suggests, spherical shaped objects which are meant to seal the perforations and prevent or inhibit fluid from within the wellbore from leaking through the perforations into the formation.

Ball sealers are typically introduced into the well at the surface and are carried down the well with the treatment fluid. A positive pressure differential is maintained between the well and the formation surrounding the well. When a ball sealer encounters an open perforation with such a pressure differential, i.e., higher pressure in the well than in the formation, the ball sealer seats itself on the perforation and is held in place by the positive pressure differential.

It is desirable that the ball sealers produce an effective seal without being permanently lodged in the perforation or the formation. Therefore, ball sealers are advantageously sized so as to maximize their sealing potential without entering into the perforation.

Ball sealers exist in a variety of diameters and densities to be applicable for different environments and to be size-appropriate for the entry holes the ball sealers are intended to seal. Ball sealers are either soluble or non-soluble.

Perforations are often shot using gun arrays that are positioned off center in the casing. A commonly used perforating gun with 90 degree shot facing produces at least two perforations with oval-shaped openings. Such ovality inherently results in a poor seal between a spherical ball sealer and the perforation. Even though perforation quality has improved in recent years, there are still perforations that have sufficiently burred openings that spherical ball sealers provide poor seals.

The perforation openings may also deteriorate before the ball sealers seat on the perforation opening. Because fluid flow tends to follow the path of least resistance, significant fluid flow may be expected through perforations that are to be sealed before ball sealers seat. Treatment fluids are often very abrasive. Therefore, this fluid flow may cause erosion of the perforation before the ball sealers seat on the opening.

Poor sealing presents problems. For one, treatment fluids are often very abrasive. If there is a fluid flow past a seated ball sealer there will likely be a very quick erosion of the ball sealer further limiting its capacity for sealing the perforation and thus eliminating the desired diversion.

Early ball sealers were usually constructed as spherical shapes with solid or hollow cores covered by a soft, thin coating applied to the surface. See for example, U.S. Pat. No. 4,102,401, to Erbstoesser, entitled Well Treatment Fluid Diversion with Low Density Ball Sealers, issued Jul. 25, 1978. Erbstoesser describes a ball sealer having an inner core of a syntactic foam (or alternatively, a thermoplastic such as polymethylpentene) covered with an elastomeric material. The syntactic foam is a material made from hollow spherical particles, for example, glass spheres, dispersed in a binder, for example, epoxy. Rubber is used as an elastometric covering material covering the syntactic foam core.

In U.S. Pat. No. 4,407,368, Erbostoesser described an improved ball sealer having a solid core covered by a polyurethane coating. Another two-layer ball sealer was introduced by Doner, et al. in U.S. Pat. No. 4,505,334 in which a thermostatic filament is wrapped around a core, after which the material is cured, and having an optional elastomeric outer covering.

Further two-layer ball sealers are described in U.S. Pat. No. 4,702,316 to Chung et al, in which a ball sealer is described that is constructed from a polymer compound covered with a thin elastomer coating. In U.S. Pat. No. 5,253,709, Kendrick et al. describe a ball sealer having a deformable shell defining a central core filled with non-deformable particulate matter that can flow with the deformable shell yet, as it consolidates under fluid flow pressure, cause the outer shell to bridge over the perforation opening.

A rigid hollow core ball sealer is described in U.S. Pat. No. 5,485,882, to Bailey et al., entitled Low-Density Ball Sealer for Use as a Diverting Agent in Hostile Environment Wells, issued, Jan. 23, 1996. Bailey's ball sealers are formed from two pieces of high-strength materials that snap together to form a hollow-core sphere. The preferred material for Bailey's ball sealers include high-strength aluminum and high-strength thermoplastic and may include a protective coating to protect the aluminum against certain solvents found in some treatment fluids.

A degradable ball sealer is described in U.S. Pat. No. 6,380,138, to Ischy et al., entitled Injection Molded Degradable Casing Perforation Ball Sealers Fluid Loss Additive and Method of Use. Ischy's ball sealers are formed from a mixture of a soluble filler material and adhesives, and have the characteristic of softening slightly in the presence of a stimulating fluid thereby ensuring a solid contact through a controlled surface deformation. Ischy's ball sealers remain intact at near surface temperatures, i.e., the temperature of injected treatment fluid, but degrade when subjected to higher temperatures such as those expected after a return of natural well bore temperatures at the conclusion of a treatment.

From the foregoing it will be apparent that while ball sealers have been successfully designed to provide various desirable capabilities, there remains a need for improvement in ball sealers that can produce efficient seals with a variety of perforation shapes.

SUMMARY

Some embodiments are methods of sealing a perforation in a wellbore using a multilayered ball sealer with a deformable layer. These methods may generally comprise injecting into the wellbore a ball sealer suspended in a fluid to the region of the perforation, the ball sealer comprising at least three layers wherein at least one layer is deformable, applying pressure in the wellbore until the ball sealer seats on the perforation and until the wellbore pressure increases to a level sufficient to deform at least one deformable layer of the ball sealer thereby producing a seal between the ball sealer and the perforation to achieve improved treatment efficiency and reservoir optimization.

In another aspect, multilayered ball sealers for use as diversion agents when applying stimulation treatments to a wellbore are disclosed. These multilayered ball sealers contain at least one deformable layer that deforms under pressure.

The multilayered ball sealers used in accordance may comprise one or more pressure deformable layers. In one class of embodiment the deformable layer is an intermediate layer; in another class of embodiments the deformable layer is another layer of the multilayered ball sealer.

An intermediate deformable layer may be selected from a group of materials including elastomers, e.g., polyisoprene, polybutadiene, polyisobutylene, polyurethane, or thermoplastic elastomers, e.g., combinations of co-polymers including at least two of polybutadiene, polyisobutylene, polyisoprene, and polyurethane.

The deformable intermediate layer may be manufactured from a material that deforms under pressure over a threshold temperature, for example, a threshold temperature in the range of 100 to 300 degrees Fahrenheit. Such a material may be, for example, a thermoplastic elastomer or a bio-polymer.

In the class of embodiments wherein the deformable layer is the outer layer of the multilayered ball sealer, the multilayered ball sealer includes an inner core, a rubber layer, and a deformable outer layer. The deformable outer layer may comprise a water-soluble material, for example, a water-soluble biopolymer or polyvinyl alcohol.

Alternatively, the outer layer is manufactured from a material that hydrolyzes above a threshold temperature, e.g., a threshold temperature in the range of 100 to 300 degrees Fahrenheit, and may be selected from the group of materials that include polyvinyl alcohol, polyglycolic acid, and lactic acid. The hydrolyzation may be controlled by controlling the pH of the wellbore fluid.

Embodiments of the invention may also include moving the perforating gun system, and repeating at least one of the placing, measuring, transmitting and adjusting steps.

In accordance with the invention, the multilayered ball sealers may be injected into the wellbore by any appropriate method including injecting from the wellhead, or introducing the multilayered ball sealers at an appropriate depth using coiled tubing, jointed tubing, and the like.

DETAILED DESCRIPTION OF SOME ILLUSTRATIVE EMBODIMENTS

Figure 1:
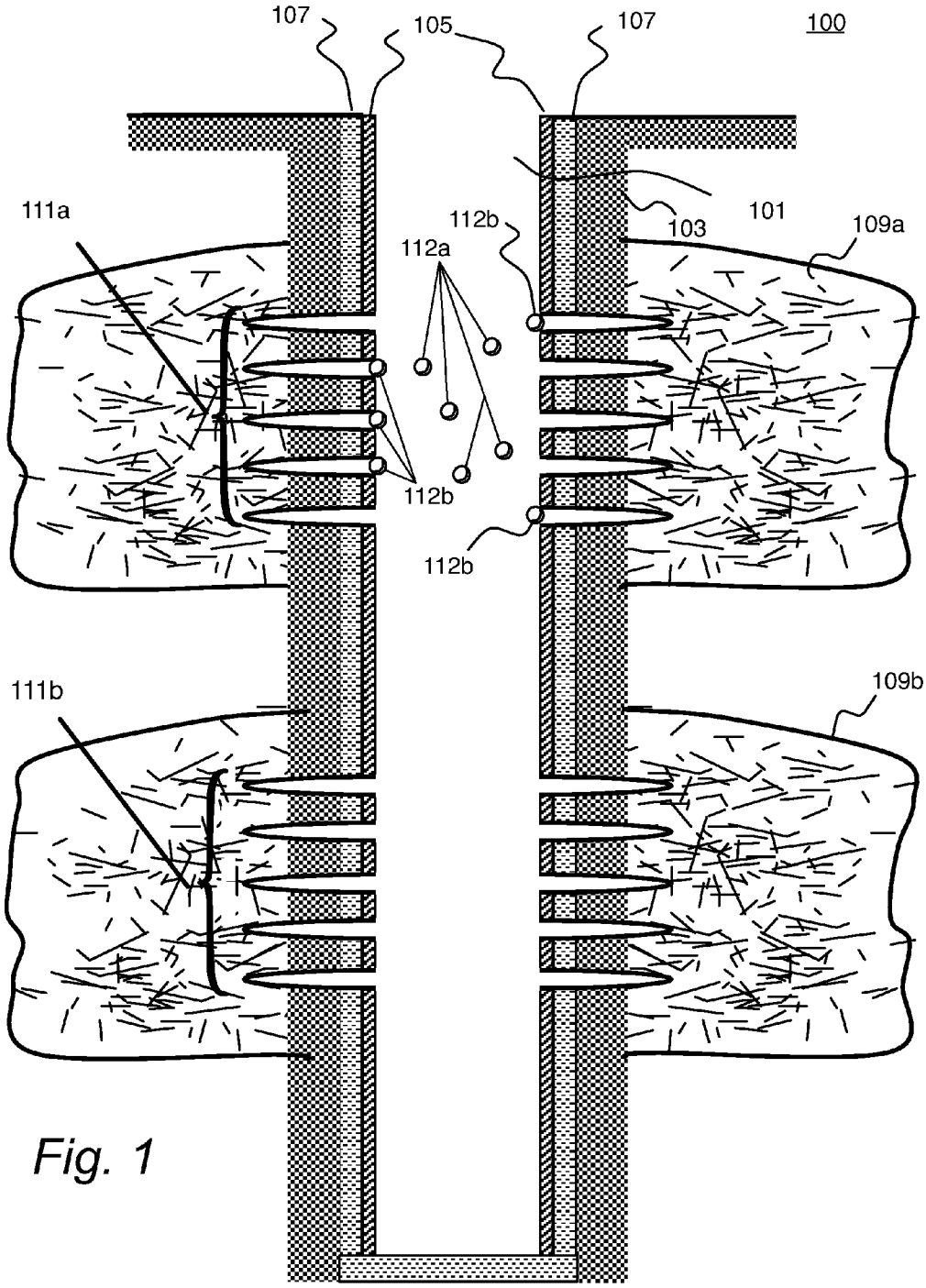
FIG. 1 illustrates a typical deployment of ball sealers as a diversion agent into a well.

In the following detailed description, reference is made to the accompanying drawings that show, by way of illustration, specific embodiments in which may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

It should also be noted that in the development of any such actual embodiment, numerous decisions specific to circumstance must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

Disclosed herein are ball sealers that provide improved capability to adapt to the shape of a perforation opening thereby efficiently sealing perforations from the wellbore while still maintaining the structural strength necessary to withstand elevated wellbore pressures.

FIG. 1 illustrates a typical deployment of ball sealers 112 as a diversion agent into a well 100. A well casing 105 has been set into the well bore of the well 100 using a cement sheathing 107. A first perforation zone 111*a* is being isolated using ball sealers 112. The ball sealers 112 are injected into the well with the treatment fluid. A positive pressure differential between the wellbore 101 and the formation 109*a* causes fluid flow through the perforations. The ball sealers 112 tend to follow that fluid flow until seating on the opening of the perforation. In the illustration of FIG. 1 certain ball sealers 112*b* are seated on a perforation opening while other ball sealers 112*a* are floating in the treatment fluid. Conceptually once all the ball sealers 112*a* have seated on perforation openings, the formation 109*a* corresponding to the first set of perforations 111*a* has been isolated from the wellbore 101. Further pumping of treatment fluid has been diverted to other zones, e.g., the lower perforation zone 111*b*. How effective the diversion is depends on how well the ball sealers 112 seal the perforations. Whether a good seal is formed depends on the shape and quality, e.g., the presence of burrs, of the perforation openings in the casing 105 and the ability of the ball sealers to adapt to the perforation openings.

Figure 2:
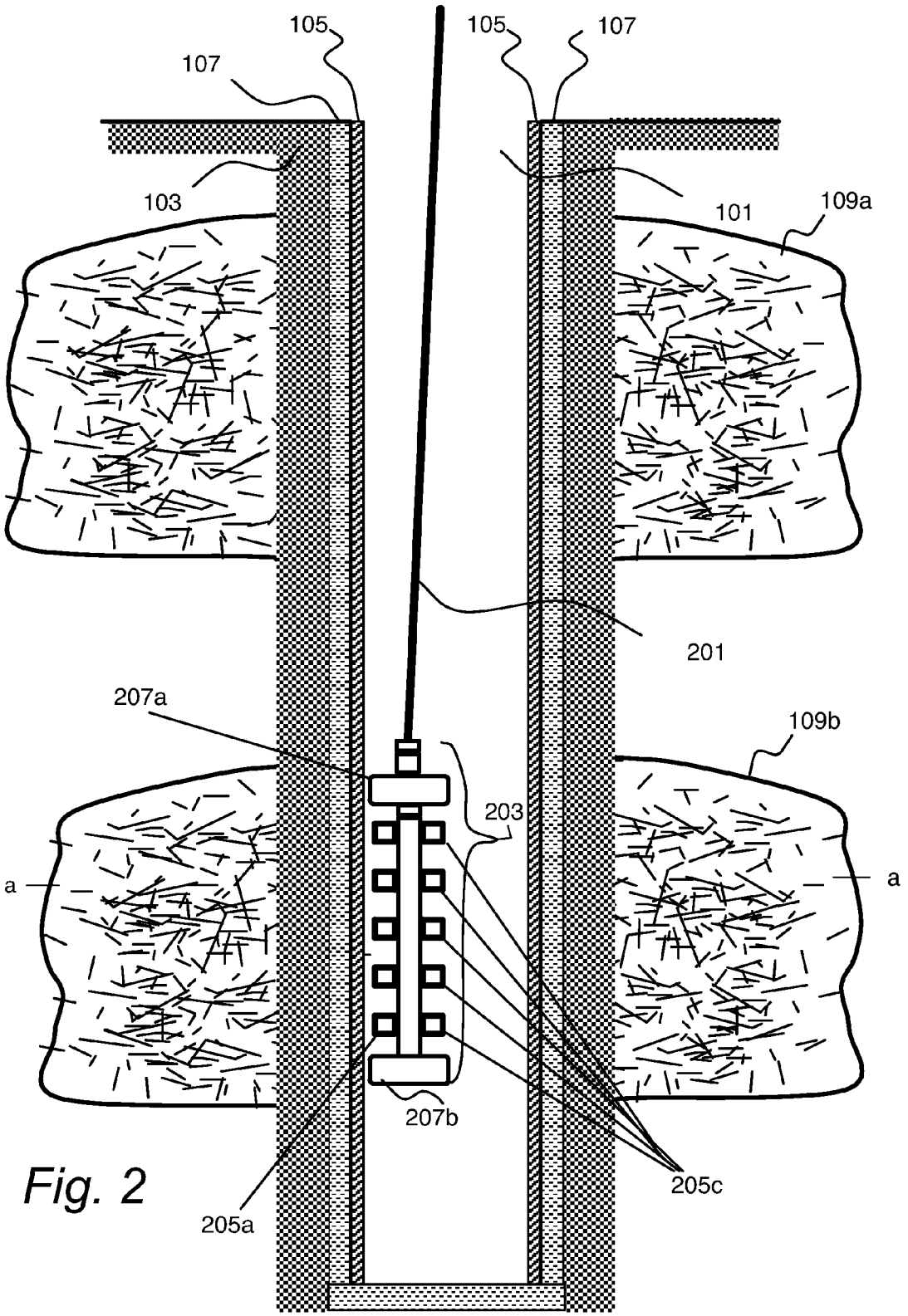
FIG. 2 is an illustration of a perforating tool assembly conveyed into the well on a wireline.

FIG. 2 is an illustration of a perforating tool assembly 203 conveyed into the well on a wireline 201. The perforation tool assembly 203 consists of an upper magnetic decentralizer 207*a* and a lower magnetic decentralizer 207*b*. The decentralizers 207 cause the perforation tool assembly 203 to be positioned adjacent to the inner wall of the casing 105. The perforation tool assembly 203 further consists of a plurality of perforating charges 205.

Figure 3:
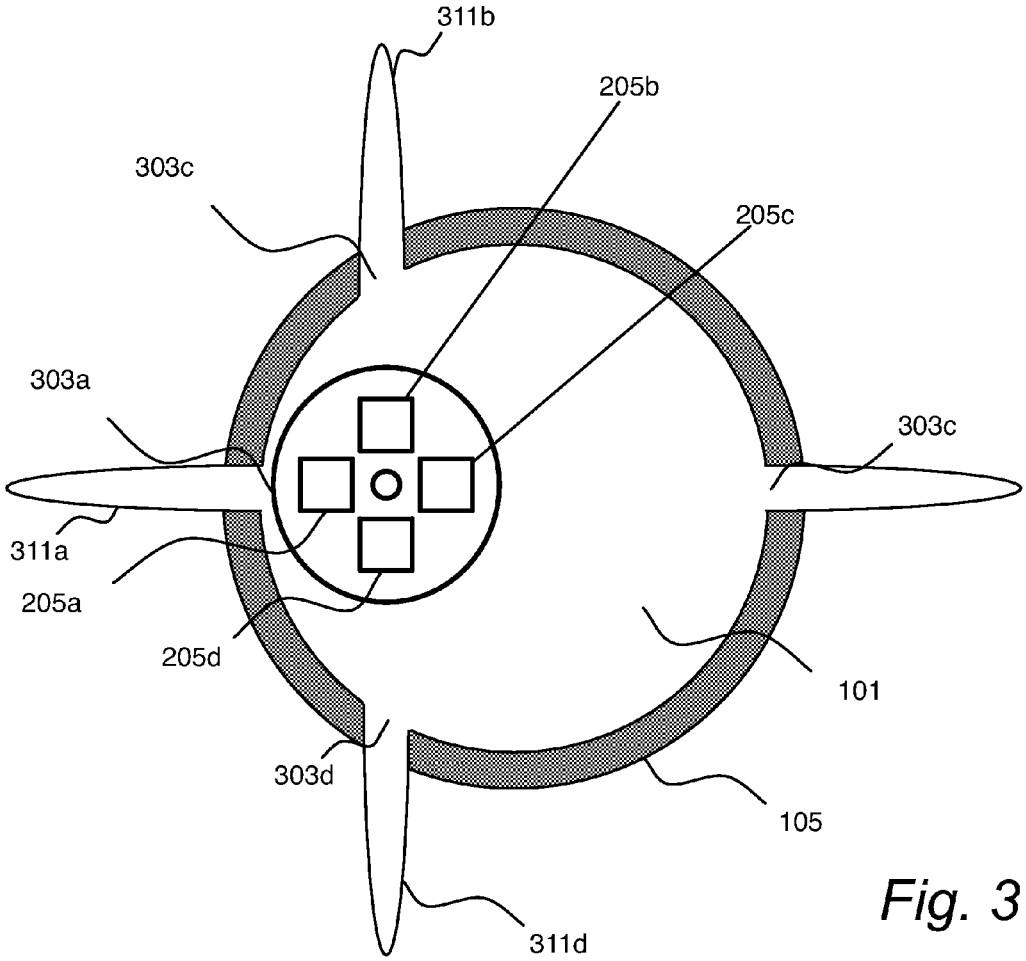
FIG. 3 is a cross-section of the casing along the line a-a of FIG. 2 and illustrating the arrangement of perforating charges at one level of the perforating tool assembly as well as cross-sections of the perforations created by these perforating charges.

FIG. 3 is a cross-section of the casing 105 along the line a-a of FIG. 2 and illustrating the arrangement of perforating charges 205 at one level of the perforating tool assembly 203 as well as cross-sections of the perforations created by these perforating charges 205. Perforating charges 205 are commonly arranged rectilinearly in a 90 degree phase shift with respect to one another, e.g., charge 205*a* is located perpendicular to charges 205*b* and 205*d* and in-line with charge 205*c*. When the perforating charges 205*a-d* are fired, the charges produce perforations 311*a-d*, respectively, with perforation openings 303*a-d*, respectively.

Figure 4:
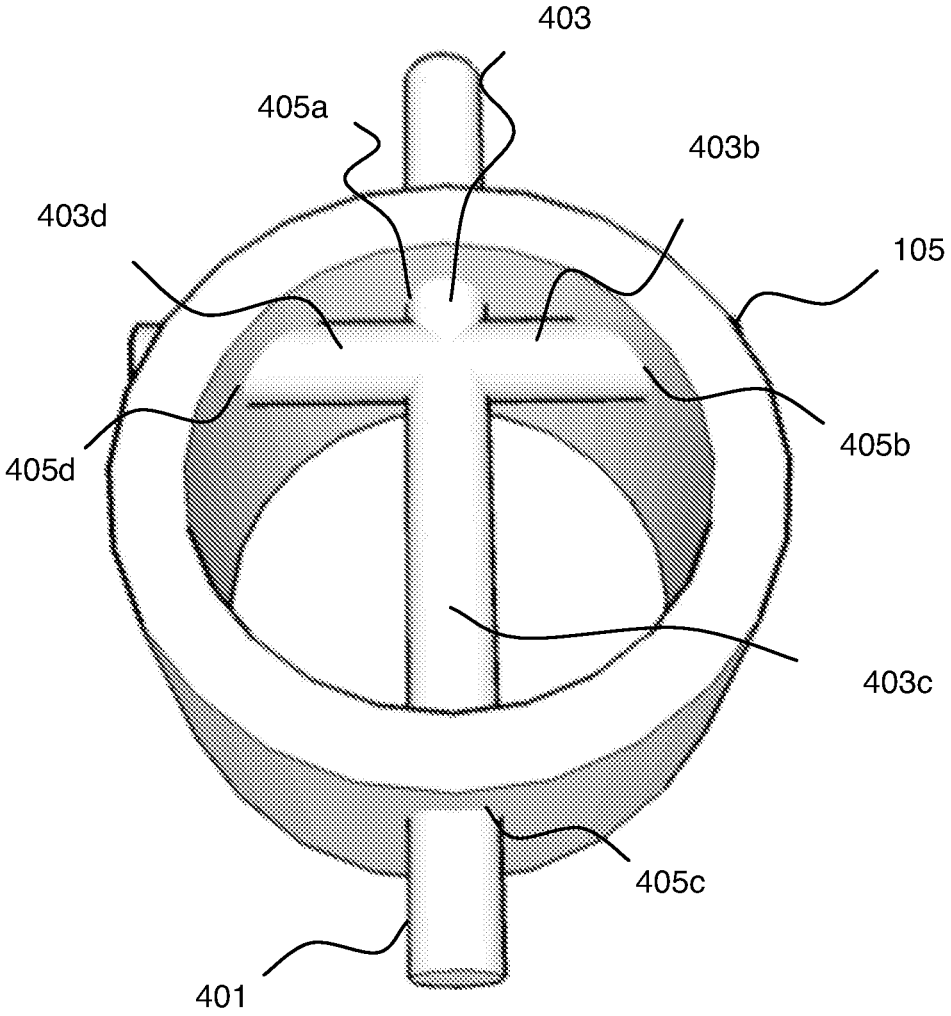
FIG. 4 is a perspective view illustrating the intersection of imaginary cylinders cut by a perforating charge and a cylindrical casing when the perforating charge is shot off-center in the casing.
Figure 5:
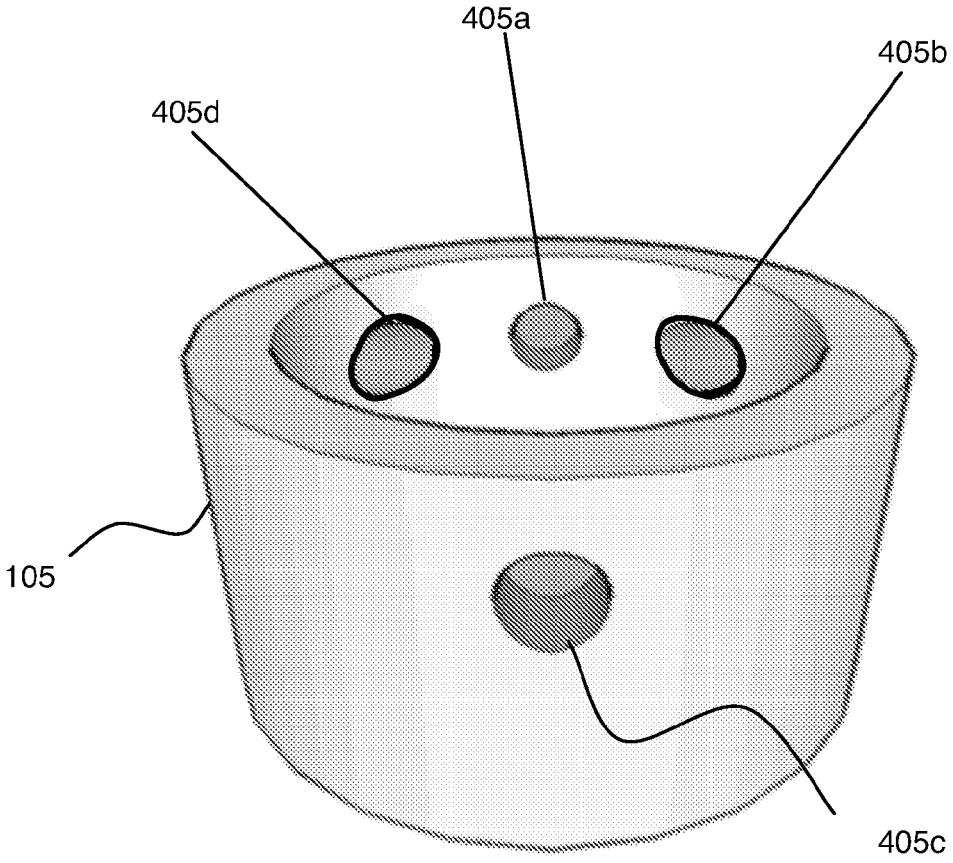
FIG. 5 is a perspective view illustrating the ovality of perforation openings shot off-center.

Because the perforations are shot off-center, the openings to perforations that are not shot radially cause the entry holes to be oval. This phenomenon is illustrated in FIGS. 4 and 5. FIG. 4 is a three-dimensional perspective view of a small section of the casing 105 illustrating the intersection of imaginary cylinders cut by a perforating charge and the cylindrical casing 105 when the perforating charge is shot off-center in the casing 105. When the perforation charges are fired, these cut cylindrical paths 403*a-d* through the wellbore and casing 105. Any of these cylinders that are non-radial with respect to the casing form oval entry holes in the casing 105, e.g., entry holes 405*b* and *d*, respectively.

The ovality of the off-center shot entry holes are further illustrated in FIG. 5. The perforations that are shot along a radius of the casing 105 have a circular shape, i.e., in the illustration of FIG. 5, perforation openings 405*a* and 405*c*. Strictly speaking, because of the curvature of the cylinder the perforation opening of radially shot perforations is also not exactly a circle but rather a curved circle. The perforation openings 405*b* and 405*d* that are shot non-radially have oval shapes.

Figure 6:
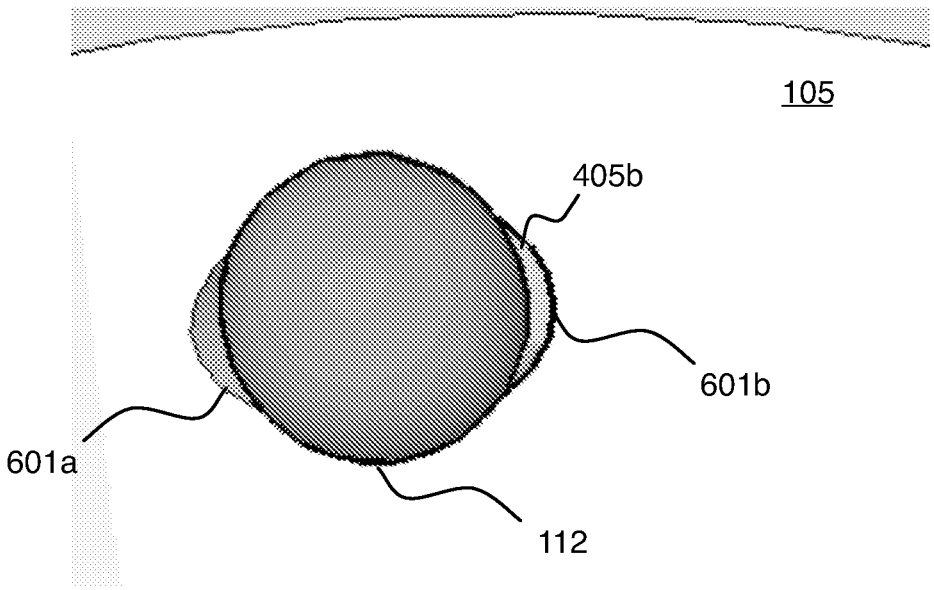
FIG. 6 is an illustration of the poor sealing between a spherical ball sealer and the oval perforation opening.

FIG. 6 is an illustration of the poor sealing between a spherical ball sealer 112 and the oval perforation opening 405*b*. The ball sealer 112 fails to close the gaps 601*a* and 601*b* because the shape of the spherical ball sealer 112 is not compatible with shape of the opening 405*b*.

Figure 7:
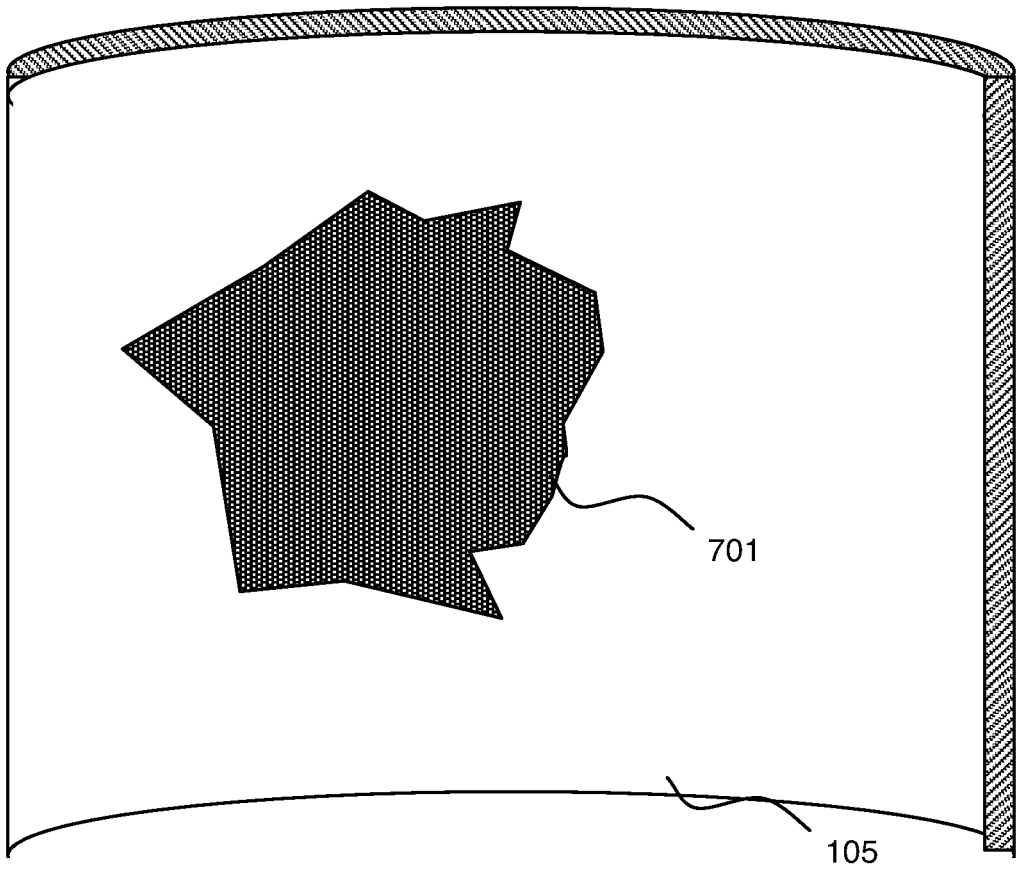
FIG. 7 an illustration of a burred perforation opening.

A similar problem occurs when the perforation charge fails to produce a regular shaped perforation opening. FIG. 7 is an illustration of a burred perforation opening 701. While the perforation opening is roughly circular, the opening is burred.

Figure 8:
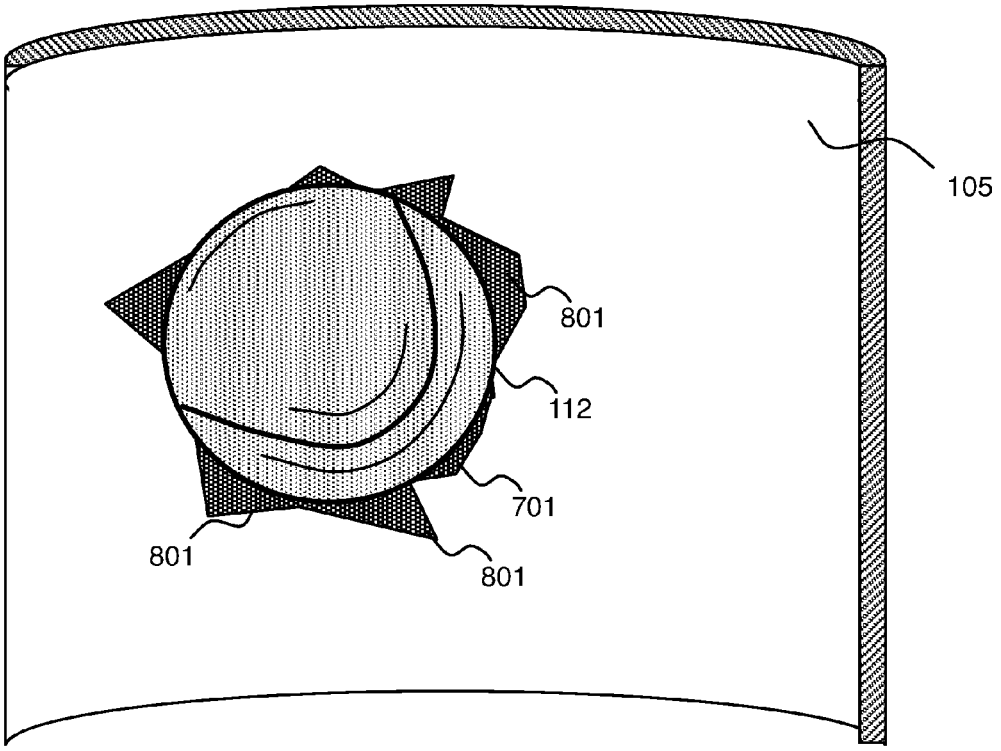
FIG. 8 an illustration of a spherical ball sealer being used in attempt to seal the perforation opening.

FIG. 8 is an illustration of a spherical ball sealer 112 being used in an attempt to seal the burred perforation opening 701. Again, a spherical ball sealer 112 would fail to close the gaps 801 because of the incompatible shapes of the ball sealer 112 and the imperfectly shaped perforation opening 701.

Figure 9:
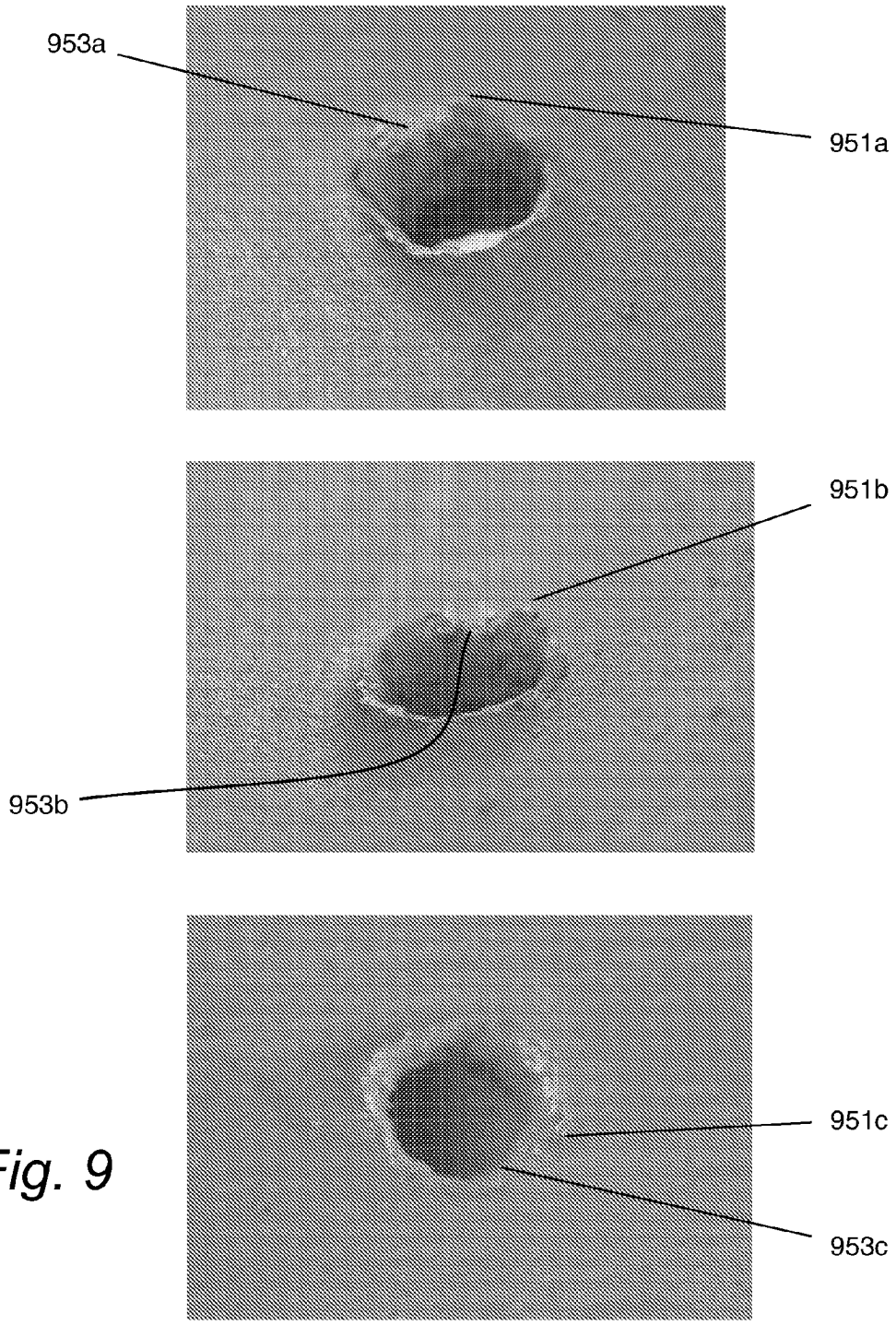
FIG. 9 is a composite of three photographs illustrating the three dimensional nature of perforation opening burrs.

FIG. 9 is a cross-section of a multilayered ball sealer 900. The multilayered ball sealer 900 has an inner core 901, an intermediate layer 903, and an outer layer 905. At least one of the three layers is a deformable layer allowing the ball sealer to adapt to irregular shapes of perforation openings.

In a first embodiment, the deformable layer is the intermediate layer 903 and the outer layer is a material capable to contain the deformable intermediate layer 903. The outer layer is further capable of adapting to the post-deformation shape of the intermediate layer 903.

The deformable layer intermediate layer 903 is manufactured from a material that deforms under pressure. Suitable materials include elastomers and thermoplastic elastomers. Suitable elastomers include polyisoprene, polybutadiene, polyisobutylene, and polyurethane. In an alternative embodiment, the intermediate layer 903 which is the deformable layer is a thermoplastic elastomer that is a combination of co-polymers including at least two of polybutadiene, polyisobutylene, polyisoprene, and polyurethane.

In an alternative embodiment, the intermediate layer 903 is manufactured from a material that deforms when seated on a perforation opening and the borehole temperature in the vicinity of the perforation the ball sealer is seated on exceeds a threshold temperature, for example, a threshold temperature in the range of 100 to 300 degrees Fahrenheit. Suitable materials with the desired property to deform above a threshold temperature include thermoplastic elastomers and biopolymers.

FIG. 9 further illustrates the deformation that occurs to the ball sealer 900*b* when seated on a perforation opening 405 in the casing 105 and pressure is applied, transformation 907, to the wellbore. The intermediate layer 903 deforms to allow the ball sealer 900*b* to adopt a shape that seals the perforation opening 405. The outer layer 905 adapts to the shape of the deformed intermediate layer 903 while the inner core retains its original, e.g., spherical, shape.

Figure 10:
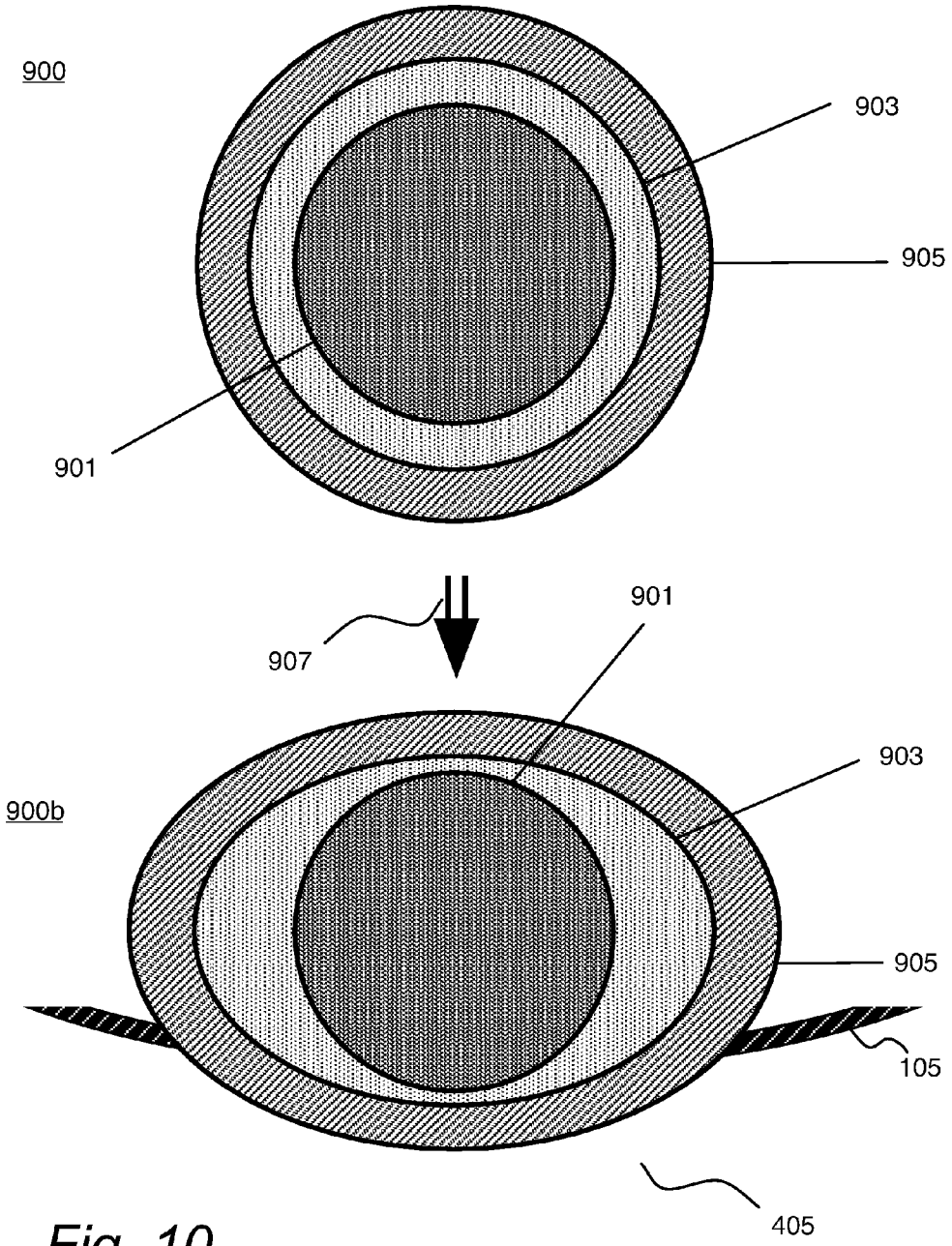
FIG. 10 is a cross-section of a multilayered ball sealer and an illustration of the deformation of the multilayered ball sealer when pressure is applied to the multilayered ball sealer while multilayeredseated on a perforation opening.
Figure 11:
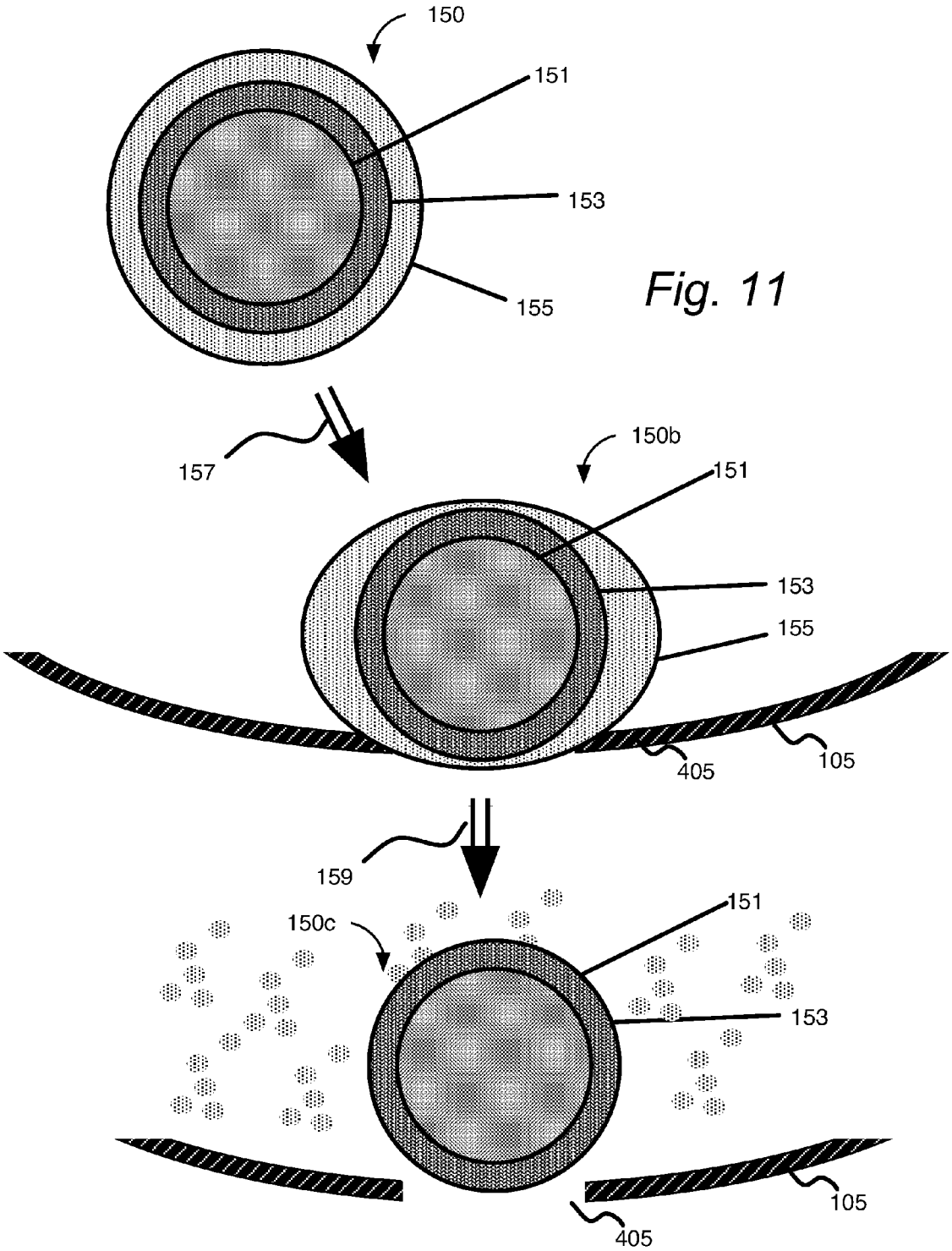
FIG. 11 is a cross-section of a multilayered ball sealer with a water-soluble or hydrolysable outer layer, an illustration of the deformation of the multilayered ball sealer when pressure is applied to the multilayered ball sealer while multilayered-seated on a perforation opening, and the opening of gaps after the dissolution or hydrolyzation of the outer layer.

In an alternative embodiment, illustrated in FIG. 10, a multi-layer ball sealer 150 has an inner core 151, an intermediate layer 153 and a deformable outer layer 155. The deformable outer layer 155 is constructed from a material that deforms under pressure, transformation 157, e.g., when seated on a perforation opening 405 and the hydrostatic pressure in the wellbore is increased to cause an increase in the positive pressure differential between the wellbore and the formation 109, thereby adopting a non-spherical shape 150*b* that adapts to the shape of the perforation opening 405 and thereby forming an effective seal between the ball sealer 150 and the perforation opening 405.

In one embodiment, the deformable outer layer 155 is manufactured from a water-soluble material, e.g., a water-soluble biopolymer or polyvinyl alcohol. Being water soluble, after a treatment process, the ball sealers 150 gradually dissolve whereby when the hydrostatic pressure reverses the ball sealers 150 readily dislodge from the perforation openings 405.

In an alternative embodiment, the deformable outer layer 155 is manufactured from a material that hydrolyzes above a threshold temperature, e.g., above a threshold temperature in the range of 100 to 300 degrees Fahrenheit. Suitable materials with the property of hydrolyzing at a suitable temperature include polyglycolic acid and polylactic acid. Hydrolyzation rate is dependent on the pH of the wellbore fluid, so accordingly, the rate of removal of the outer layer 155 may be controlled by adjusting the pH of the wellbore fluid.

When the outer layer has dissolved or hydrolyzed, transformation 159, the resulting ball sealer 150*c* comprises only the remaining intermediate layer 153 and inner core 151. When the hydrostatic pressure differential reverses at the conclusion of the treatment process, the ball sealer 150*c* more easily dislodges from the perforation opening 405 because of the gaps that may have formed from the dissolution or hydrolyzation of the outer layer 155.

The size of ball sealer used as a diversion agent depends on the size of the perforations in a casing. Typical ball sealer outer diameters are in the range of ⅝ inches and 1.5 inches. In one embodiment, a multilayered ball sealer 900 or 150 as described hereinabove has an outer diameter in that range with a deformable layer ranging in thickness between ⅛ inch and ⅜ inch. In alternative embodiments, the ball sealers 900 and 150 have non-spherical shapes such as being egg-shaped or ellipsoid. Such shapes may further improve the seal between the perforation opening 405 and the ball sealer 900 or 150. In one embodiment, the deformable layer of such a multilayered ball sealer 900 or 150 would range in thickness between ⅛ inch and ⅜ inch.

The multilayered ball sealers 900 and 150 may be employed as a diversion agent to achieve zonal isolation by suspending the ball sealers 900 and 150 in a fluid injected into a wellbore. Pressure is then applied until the ball sealers 900 and 150 are seated on perforation openings 405 and deform from the hydrostatic pressure differential between the wellbore and the formation thereby forming an effective seal between the wellbore and the formation into which the perforation reaches.

The multilayered ball sealers may be injected into the wellbore by any appropriate method including injecting from the wellhead, or introducing the multilayered ball sealers at an appropriate depth using coiled tubing, jointed tubing, and the like.

The herein-disclosed embodiments of the invention may be used advantageously in multi-zonal treatment operations, i.e., wherein the perforating gun assembly and related treatment apparatus is moved from one treatment zone to another. Such operations include moving the perforating gun system, and repeating at least one of the steps of placing ball sealers, performing a treatment, measuring properties indicative of results. Multi-zonal stimulation is described in co-pending patent application, U.S. Ser. No. 12/039,583, the entire disclosure of which is incorporated herein by reference thereto.

The particular embodiments disclosed above are illustrative only, as they may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about A to about B," or, equivalently, "from approximately A to B," or, equivalently, "from approximately A-B") disclosed herein is to be understood as referring to the power set (the set of all subsets) of the respective range of values. Accordingly, the protection sought herein is as set forth in the claims below.

We claim:

1. A method of sealing a perforation in a wellbore comprising:

injecting into the wellbore a ball sealer suspended in a fluid to the region of a perforation zone, the ball sealer comprising:

an inner core which retains its original shape when seated upon a perforation opening in the wellbore;

at least two layers disposed upon the inner core, wherein at least one intermediate layer between the inner core and an outer layer is deformable, and wherein the at least one intermediate layer is elastomeric;

applying pressure in the wellbore until the ball sealer seats on the perforation and until the wellbore pressure increases to a level sufficient to deform the at least one deformable intermediate layer of the ball sealer thereby producing a seal between the ball sealer and the perforation.

2. The method of sealing a perforation in a wellbore of claim 1 wherein the ball sealer comprises the inner core, an intermediate layer, and an outer layer wherein the deformable layer is the intermediate layer comprising a material that deforms under pressure and the outer layer comprises a layer of a material to contain the intermediate layer as the intermediate layer deforms and having the ability to adapt to a post-deformation shape of the intermediate layer.

3. The method of claim 2 wherein the material that deforms under pressure comprises a material selected from the group including elastomers and thermoplastic elastomers.

4. The method of claim 3 wherein the material that deforms under pressure is an elastomer selected from the group including polyisoprene, polybutadiene, polyisobutylene, and polyurethane.

5. The method of claim 3 wherein the material that deforms under pressure is a thermoplastic elastomer that is a combination of co-polymers including at least two of polybutadiene, polyisobutylene, polyisoprene, and polyurethane.

6. The method of sealing a perforation in a wellbore of claim 1:

wherein the deformable layer is the intermediate layer; and, wherein the intermediate layer comprises a material that deforms above a threshold temperature when the ball sealer seats on a perforation and the outer layer comprises a layer of a material to contain the intermediate layer as the intermediate layer deforms and having the ability to adapt to a post-deformation shape of the intermediate layer.

7. The method of claim 6 wherein the material that deforms above a threshold temperature comprises a material that deforms at temperatures in the range of 100 to 300 degrees Fahrenheit.

8. The method of claim 7 wherein the material that deforms above a threshold temperature comprises a thermoplastic elastomer.

9. The method of claim 7 wherein the material that deforms above a threshold temperature comprises a biopolymer.

10. The method of claim 1 wherein the outer diameter of the ball sealer is between ⅝ inches and 1.5 inches and the deformable layer has a thickness between ⅛ inch and ⅜ inch.

11. The method of claim 1 wherein the ball sealer has a non-spherical three-dimensional shape and the deformable layer has an average thickness ranging between ⅛ inch and ⅜ inch.

12. The method of claim 1 wherein the inner core is a non-deformable structure.

13. The method of claim 1 wherein the ball sealer comprises an outer layer comprising a material which hydrolyzes above a threshold temperature.

14. The method of claim 13 wherein the material is polyglycolic acid.

15. The method of claim 13 wherein the material has a hydrolyzation rate dependent on the pH of a wellbore fluid.

16. The method of claim 15 wherein the rate of removal of the outer layer is controlled by adjusting the pH of the wellbore fluid.

17. A ball sealer for sealing a perforation in a wellbore comprising an inner core and at least two layers disposed upon the inner core of the ball sealer, wherein at least one intermediate layer between the inner core and an outer layer is deformable under wellbore pressure, wherein the inner core is a non-deformable structure, and wherein the at least one intermediate layer is elastomeric.

18. The ball sealer for sealing a perforation in a wellbore of claim 17 wherein the ball sealer comprises the inner core, an intermediate layer, and an outer layer wherein the deformable layer is the intermediate layer comprising a material that deforms under pressure and the outer layer comprises a layer of material able to contain the intermediate layer as the intermediate layer deforms and having the ability to adapt to a post-deformation shape of the intermediate layer.

19. The ball sealer of claim 17 wherein the material that deforms under pressure comprises an elastomer selected from the group including polyisoprene, polybutadiene, polyisobutylene, and polyurethane.

20. The ball sealer of claim 17 wherein the material that deforms under pressure is a thermoplastic elastomer that is a combination of co-polymers including at least two of polybutadiene, polyisobutylene, polyisoprene, and polyurethane.

21. The ball sealer of claim 17 wherein the ball sealer comprises the inner core, an intermediate layer, and an outer layer;

wherein the deformable layer is the intermediate layer; and wherein the intermediate layer comprises a material that deforms above a threshold temperature when the ball sealer seats on a perforation and the outer layer comprises a layer of a material to contain the intermediate layer as the intermediate layer deforms and having the ability to adapt to a post-deformation shape of the intermediate layer.

22. The ball sealer of claim 17 wherein the material that deforms under pressure above a threshold temperature comprises a material that deforms at temperatures in the range of 100 to 300 degrees Fahrenheit.

23. The ball sealer of claim 22 wherein the material that deforms above a threshold temperature comprises a thermoplastic elastomer.

24. The ball sealer of claim 22 wherein the material that deforms above a threshold temperature comprises a biopolymer.

25. The ball sealer of claim 17 comprising an outer layer which comprises a material which hydrolyzes above a threshold temperature.

26. The ball sealer of claim 25 wherein the material comprises at least of polyglycolic acid and polylactic acid.

27. The ball sealer of claim 25 wherein the material has a hydrolyzation rate dependent on the pH of a wellbore fluid.

28. The ball sealer of claim 27 wherein the rate of removal of the outer layer is controlled by adjusting the pH of the wellbore fluid.

29. A method comprising:

injecting into the wellbore a ball sealer suspended in a fluid to the region of a perforation zone, the ball sealer comprising:

an inner core which retains its original shape when seated upon a perforation opening in the wellbore, and wherein the inner core is a single non-deformable structure;

at least two layers disposed upon the inner core, wherein at least one layer is a deformable intermediate layer, and at least one other layer is an outer layer wherein the intermediate layer comprises a material that deforms under pressure and the outer layer comprises a layer of a material to contain the intermediate layer as the intermediate layer deforms and having the ability to adapt to a post-deformation shape of the intermediate layer, wherein the at least one intermediate layer is elastomeric;

applying pressure in the wellbore until the ball sealer seats on the perforation and until the wellbore pressure increases to a level sufficient to deform the at least one deformable intermediate layer of the ball sealer thereby producing a seal between the ball sealer and the perforation.

30. The method of claim 29 wherein the material that deforms under pressure comprises a material selected from the group including elastomers and thermoplastic elastomers.

31. The method of claim 30 wherein the material that deforms under pressure is an elastomer selected from the group including polyisoprene, polybutadiene, polyisobutylene, and polyurethane.

32. The method of claim 30 wherein the material that deforms under pressure is a thermoplastic elastomer that is a combination of co-polymers including at least two of polybutadiene, polyisobutylene, polyisoprene, and polyurethane.

* * * * *